United States Patent [19]

Cairo et al.

[11] 4,176,903

[45] Dec. 4, 1979

[54] PLUG IN IGNITER UNIT AND METHOD OF MAKING THE SAME

[75] Inventors: Anthony C. Cairo; Ditmar K. Tillmann; Gene I. Insley, all of Holland, Mich.

[73] Assignee: Robertshaw Controls Company, Richmond, Va.

[21] Appl. No.: 853,284

[22] Filed: Nov. 21, 1977

[51] Int. Cl.[2] ..... F23Q 7/22; H01R 3/00; H01R 5/02

[52] U.S. Cl. ..... 339/147 R; 219/270; 431/132; 339/275 R

[58] Field of Search ..... 339/147 SU, 275 R, 276 R; 126/39 R, 39 E, 39 BA; 219/260, 267, 270; 431/132, 25 B, 263; 338/322, 326, 329, 332

[56] References Cited

U.S. PATENT DOCUMENTS

| | | | |
|---|---|---|---|
| 3,569,787 | 3/1971 | Palmer | 219/270 X |
| 3,812,324 | 5/1974 | Faffaelli et al. | 219/270 X |
| 4,003,014 | 1/1977 | Branson et al. | 338/332 X |

*Primary Examiner*—E. F. Desmond
*Attorney, Agent, or Firm*—Candor, Candor & Tassone

[57] ABSTRACT

A plug in igniter unit for an igniter system for a fuel burning apparatus having at least one electrical receptacle, the plug in igniter unit being provided with a housing having an electrical igniter therein and at least one terminal member electrically interconnected to the electrical igniter and projecting from the housing so as to be adapted to be received in the receptacle for electrical interconnection thereto. The terminal member has opposed ends respectively being operatively interconnected to the igniter and being adapted to be plugged in the receptacle and being twisted between the opposed ends thereof to define a twisted section thereof. The housing has a body portion provided with a chamber passing therethrough and receiving the twisted section whereby the opposed ends of the terminal member extend outwardly from the body portion in opposite directions. A potting compound is disposed in the chamber to secure the twisted section of the terminal member to the body portion.

7 Claims, 7 Drawing Figures

PLUG IN IGNITER UNIT AND METHOD OF MAKING THE SAME

BACKGROUND OF THE INVENTION

1. Field of the Invention

This invention relates to an improved plug in igniter unit and method of making the same as well as to an igniter system for a fuel burning apparatus and utilizing such igniter unit.

2. Prior Art Statement

It is well known to provide electrical igniter means for a fuel burning apparatus.

For example, see the following four items:

(1) U.S. Pat. No. 2,761,947—Rice et al.;

(2) U.S. Pat. No. 3,823,345—Mitts et al.;

(3) U.S. Pat. No. 4,003,014—Branson et al.;

(4) U.S. Pat. No. 4,003,360—Branson.

The igniter system of item (1) above appears to include a self-contained plug in igniter unit that is adapted to plug into socket openings of a receptacle that is adapted to be fastened to a fuel burning apparatus.

The igniter systems of items (2)-(4) above each appears to disclose igniter units that are adapted to be permanently attached to the fuel burning apparatus.

SUMMARY OF THE INVENTION

It was found according to the teachings of this invention that the electrical igniters of plug in igniter units should be isolated from adverse forces during the handling of the plug in igniter units, such as during the plugging in of the same into the cooperating electrical receptacles therefor.

Accordingly, it is a feature of this invention to provide an improved plug in igniter unit having means for tending to isolate the electrical igniter thereof from the prong ends of the unit.

In particular, one embodiment of this invention provides a plug in igniter unit for an igniter system for a fuel burning apparatus having at least one electrical receptacle, the plug in igniter unit being provided with a housing means having an electrical igniter therein and terminal means electrically interconnected with the electrical igniter and projecting from the housing means in order to be adapted to be received in the receptacle for electrical interconnection thereto. The terminal means comprises at least one blade-like terminal member having opposed ends respectively being operatively interconnected to the igniter and being adapted to be plugged into the receptacle and being twisted between the opposed ends thereof to define a twisted section thereof. The housing means has a body portion provided with a chamber passing therethrough and receiving the twisted section of the terminal member whereby the opposed ends of the terminal member extend outwardly from the body portion in opposite directions. Securing means, such as a potting compound, is disposed in the chamber to secure the twisted section to the body portion and thereby tend to isolate adverse forces that might be imposed on the prong end of the terminal member from the interconnection of the other end thereof with the electrical igniter.

Accordingly, it is an object of this invention to provide an improved plug in igniter unit having one or more of the novel features of this invention as set forth above or hereinafter shown or described.

Another object of this invention is to provide a method of making such a plug in igniter unit, the method of this invention having one or more of the novel features of this invention as set forth above or hereinafter shown or described.

Another object of this invention is to provide an improved plug in igniter system for a fuel burning apparatus or the like, the system of this invention having one or more of the novel features of this invention as set forth above or hereinafter shown or described.

Other objects, uses and advantages of this invention are apparent from the reading of this description which proceeds with reference to the accompanying drawings forming a part thereof and wherein:

DESCRIPTION OF THE PREFERRED EMBODIMENT

Figure 1:
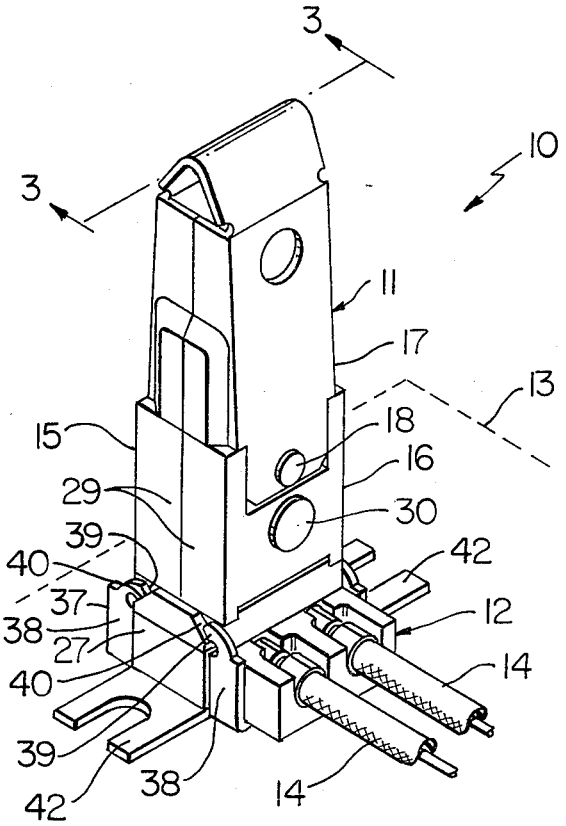
FIG. 1 is a perspective view illustrating the improved plug in igniter unit of this invention plugged into an electrical receptacle therefor to complete the igniter system of this invention.

While the various features of this invention are hereinafter described and illustrated as being particularly adapted to provide an igniter means for a fuel burning cooking apparatus, it is to be understood that the various features of this invention can be utilized singly or in any combination thereof to provide igniter means for other types of fuel burning apparatus as desired.

Therefore, this invention is not to be limited to only the embodiment illustrated in the drawings, because the drawings are merely utilized to illustrate one of the wide variety of the uses of this invention.

Figure 2:
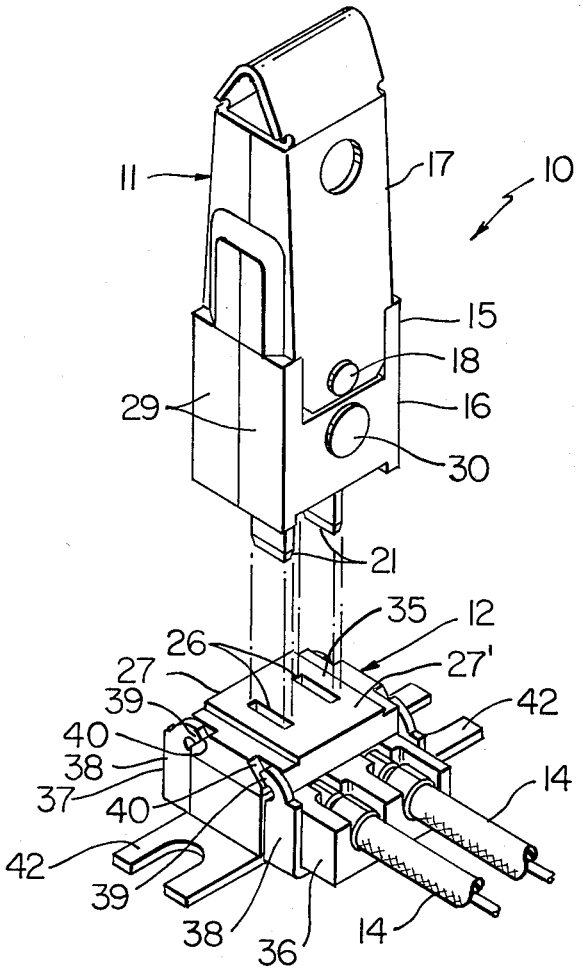
FIG. 2 is a view similar to FIG. 1 and illustrates the plug in igniter unit before the same is received in its cooperating receptacle.
Figure 3:
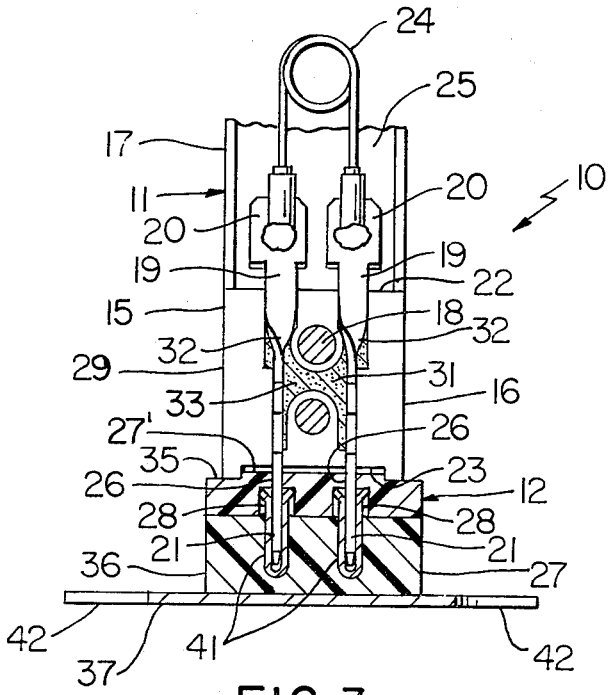
FIG. 3 is a fragmentary cross-sectional view taken on line 3—3 of FIG. 1.
Figure 4:
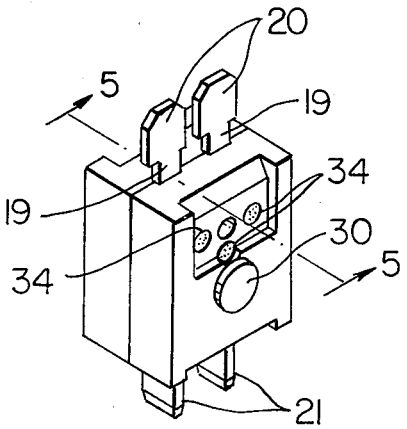
FIG. 4 is a perspective view of a part of the plug in igniter unit of FIGS. 1-3.

Referring now to FIGS. 1-3, the improved plug in igniter system of this invention is generally indicated by the reference numeral 10 and comprises a plug in igniter unit of this invention that is generally indicated by the reference numeral 11 and an electrical receptacle of this invention that is generally indicated by the reference numeral 12 and is adapted to be fastened to any desired supporting frame structure of a fuel burning apparatus that is schematically indicated by the dash line 13 in FIG. 1. For example, the fuel burning apparatus 13 can comprise a gas cooking range or the like wherein the igniter system 10 is adapted to ignite one or more of the main burners thereof when the igniter system has the electrical leads 14 of the receptacle 12 interconnected to a suitable electrical power source (not shown) through suitable electrical switch means in a manner well known in the art.

The plug in igniter unit 11 of this invention comprises a housing means 15 having a main body portion 16 and a hood portion 17 secured to the body portion 16 in any suitable manner, such as by a suitable rivet means 18 as illustrated.

The body portion 16 of the igniter unit 11 carries two blade-like conductive terminal members 19 each of which has opposed ends 20 and 21 respectively projecting beyond opposed ends 22 and 23 of the body portion 16 whereby the projecting ends 20 of the terminal members 19 are adapted to be respectively electrically interconnected to an electrical igniter coil 24 in any suitable manner, such as by the method described and illustrated in the aforementioned U.S. Pat. No. 4,003,014, to Branson et al.

In this manner, the electrical igniter 24 will be disposed within an internal chamber 25 of the hood 17 to provide its igniting function when the same is electrically energized. For example, the electrical igniter 24 can be of the type and be energized in the manner illustrated and described in the aforementioned U.S. Pat. Nos. 3,832,345; 4,003,014 and 4,003,360.

The other projecting ends 21 of the terminal members 19 are adapted to be plugged into cooperating socket openings 26 formed in the outer surface 27' of the receptacle 12 to be respectively and conductively received in conductive socket members 28, FIGS. 3 and 7, electrically interconnected to the ends of the leads 14 and held within the receptacle 12 in a manner hereinafter set forth.

The body portion 16 of the plug in igniter unit 11 is formed of two like parts 29 secured together in any suitable manner, such as by the rivet means 30 illustrated in the drawings, and define a chamber means 31 therein which passes completely through the opposed ends 22 and 23 thereof and receives the intermediate portions of the terminal members 19 therein as illustrated.

While the sections 29 of the body portion 16 of the plug in igniter unit 11 can be formed of any suitable material, the same can be formed of ceramic material, such as Steatite manufactured by Duco Ceramics Co. of Saxonburg, Pa.

Each terminal member 19 is twisted intermediate its opposed ends 20 and 21 to define a twisted section 32 as illustrated in the drawings. In this manner, the twisted sections 32 of the terminal members 19 are fully disposed within the chamber 31 of the body portion 16.

While the terminal members 19 are each illustrated as being twisted approximately 90° as illustrated in the drawings, it is to be understood that the same could have any desired degree of twist provided therein that would cause the same to function in a manner hereinafter set forth.

During the manufacture of an igniter unit 11 of this invention, the terminal members 19 are first assembled into one section 29 of the body portion 16 and then the other section 29 is assembled therewith whereby the lower portions of the terminal members 19 are firmly captured in the cooperating lower parts of the chamber 31 to hold the same in their assembled relation while the rivet means 30 is utilized to initially secure the body parts 29 and terminal members 19 together in their assembled relation. Thereafter, a suitable adhesive compound 33 is injected into the chamber 31 to substantially fill the same and thereby firmly bond the twisted sections 32 of the terminal members 19 to the body portion 16 of the housing means 15 and thereby tend to isolate the projecting ends 21 of the terminal members 19 from the ends 20 thereof that are secured to the electrical igniter 24.

For example, any subsequent pulling outwardly or pushing inwardly on a particular terminal end 21 would tend to cause the same to have a spiral movement at the twisted section 32 thereof that is completely resisted by the hardened securing compound 33.

While the securing means 33 can be any suitable material, a particular ceramic adhesive potting compound that has been found satisfactory for use with the aforementioned ceramic material for the body portion 16 is Ultrabond #522, manufactured by Aremco Products, Inc., of Ossining, N.Y.

If desired, each housing part 29 can be provided with a plurality of openings 34 which lead from the exterior thereof to the chamber 31 and through which the securing compound 33 can be injected. For example, either before or after the igniter 24 has been secured to the projecting terminal parts 20, the openings 34 in one of the parts 29 can be closed by a suitable fixture and the adhesive compound 33 can be injected through one of the openings 34 in the other part 29 until the compound 33 begins to ooze out of the other openings 34 in that particular part 29 of the body portion 16 to indicate that the chamber 31 has been suitably filled with the compound 33.

Thus, it can be seen that the plug in igniter unit 11 can be formed by the above-described method of this invention to insure that the projecting parts 21 of the terminal members 19 will be firmly isolated by the body portion 16 from the ends 20 thereof that are secured to the electrical igniter 24 so that when the plug in igniter unit 11 is subsequently plugged into the receptacle 12, inadvertent movement of the projecting parts 21 of the plug in igniter unit 11 will be isolated from the interconnection of the other ends 20 thereof with the electrical igniter 24 so as to tend to prevent any adverse effects on the electrical igniter 24.

While the terminal members 19 can be formed of any suitable material, it was found according to the teachings of this invention that because of the high heat developed by the igniter 24 being energized to provide its igniting function, the terminal members 19 can be formed of stainless steel and have precious metal disposed on at least the ends 21 thereof that will be received in the socket members 28 of the leads 14. In this manner, adverse deterioration of the terminals 19 at their ends 21 will be substantially eliminated.

Accordingly, one particular type of terminal member 19 that has been found satisfactory is formed from approximately 0.032 of an inch thick type 430 stainless steel that has been silverplated approximately 0.00015 of an inch thick over a nickel plating thereon of approximately 0.0001 of an inch thick at the end 21 thereof, such terminal members being supplied by Amp, Inc., of Harrisburg, Pa.

When such terminal members 19 have been utilized, it has been found that the socket members 28 for the leads 14 of the receptacle 12 can also be formed of stainless steel covered with a precious metal, such as stainless steel of approximately 0.012 of an inch thick and type no. 302, temper B and be finished with a silverplating of approximately 0.00015 of an inch thick over a nickel plating of approximately 0.0001 of an inch thick thereon, such socket members 28 also being supplied by Amp, Inc., of Harrisburg, Pa.

In this manner, it is believed that the high temperatures encountered by repeated use of the igniter 24 for its igniting function, will not deteriorate the projecting portions 21 of the plug in igniter unit 11 and/or the socket members 28 of the receptacle 12 to an adverse degree over a suitable long life cycle of the igniter system 10 of this invention.

The receptacle 12 for the igniter system 10 of this invention has the body portion 27 thereof formed from two parts 35 and 36 suitably shaped as illustrated in order to capture the electrical sockets 28 of the leads 14 therebetween when the parts 35 and 36 are assembled against each other as illustrated in FIG. 2 after the sockets 28 and leads 14 have been assembled in the channels 41 of the part 36.

Figure 7:
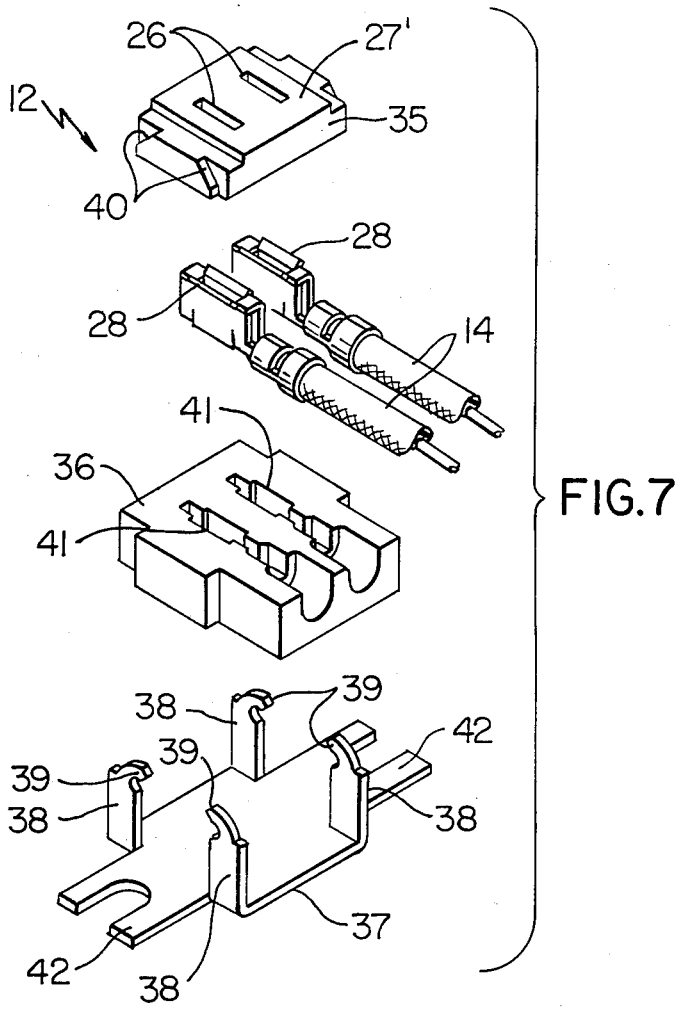
FIG. 7 is an exploded perspective view of the various parts that form the electrical receptacle that completes the igniter system of FIGS. 1-3.
Figure 5:
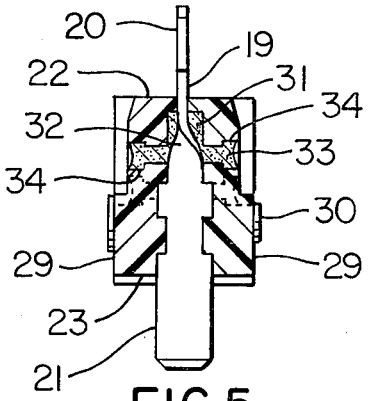
FIG. 5 is a cross-sectional view taken on lines 5—5 of FIG. 4.
Figure 6:
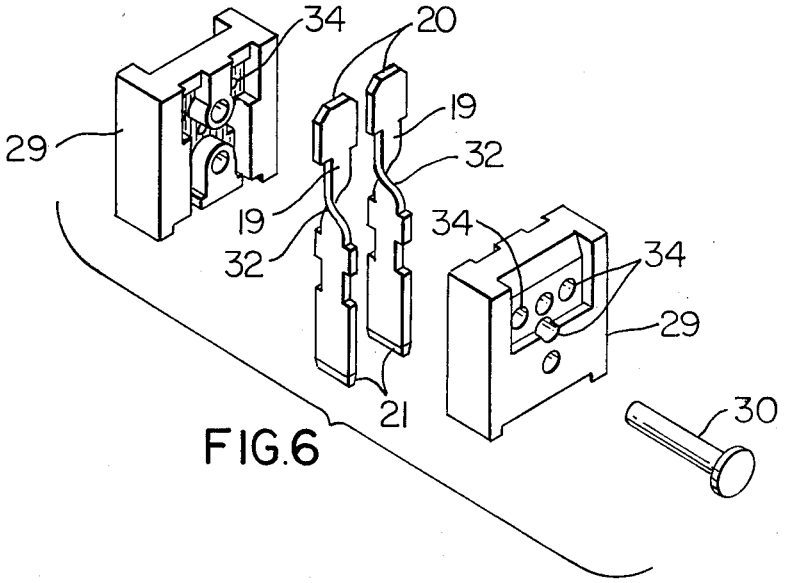
FIG. 6 is an exploded perspective view of the parts forming the particular part of the igniter unit that is illustrated in FIGS. 4 and 5.

The receptacle 12 also includes a metallic mounting bracket 37 which is initially shaped as illustrated in FIG. 7 so that the lower portion 36 of the receptacle 12 can be disposed between the plurality of upstanding legs 38 of the mounting bracket 37 with the cover member 35 thereon as illustrated in FIG. 2. In this manner, the free ends 39 of the legs 38 can be subsequently bent downwardly toward each other against angled shoulders 40 on the cover part 35 to firmly fasten the three parts 35, 36 and 37 in the assembled relation illustrated in FIG. 2 whereby the socket members 28 and leads 14 are fully captured within the cooperating slot means 41 of the part 36 of the receptacle 12.

The mounting bracket 37 can have outwardly extending ears 42 which will readily permit the receptacle 12 to be mounted to the fuel burning apparatus 13 by suitable fastening means in a manner well known in the art.

The parts 35 and 36 of the receptacle 12 can be formed of the same ceramic material that forms the parts 29 of the body portion 16 of the plug in igniter 11 or they can be formed of any other suitable material, as desired.

Thus, it can be seen that the receptacle 12 can be assembled from relatively simple parts in a relatively inexpensive manner to form the receptacle 12 for the plug in igniter system 10 of this invention and thereby readily receive the plug in igniter unit 11 to complete the system 10 in the manner previously described.

In the operation of the system 10, it can be seen that when electrical current is interconnected by the leads 14 to the socket members 28 thereof, the terminal members 19 of the plug in igniter unit 11 interconnect the socket members 28 to the igniter 24 so that the same can glow in the manner set forth in the aforementioned U.S. patents, to provide an ignition means for the burner means of the fuel burning apparatus 13 in the manner set forth in the aforementioned U.S. patents whereby the operation of the system 10 need not be further described.

However, it can readily be seen that should an igniter unit 11 of the system 10 need replacing, the unit 11 to be replaced can be readily unplugged from its receptacle 12 as illustrated in FIG. 2 and a new igniter unit 11 can be plugged into the same receptacle 12 in the manner also illustrated in FIG. 2.

Thus, it can readily be seen that this invention not only provides an improved plug in igniter unit and method of making the same, but also this invention provides an improved plug in igniter system utilizing such plug in igniter unit.

While the forms of the invention now preferred have been illustrated and described as required by the Patent Statute, it is to be understood that other forms can be utilized and still fall within the scope of the appended claims.

What is claimed is:

1. In a plug in igniter system for a fuel burning apparatus having at least one electrical receptacle and a plug in igniter unit provided with a housing means having an electrical igniter therein and terminal means electrically interconnected to said electrical igniter and projecting from said housing means to be received in said receptacle for electrical interconnection thereto, the improvement wherein said terminal means comprises at least one blade-like terminal member having opposed ends respectively being interconnected to said igniter and said receptacle and being twisted between said opposed ends thereof to define a twisted section thereof, said housing means having a body portion provided with a chamber passing therethrough and receiving said twisted section therein whereby said opposed ends of said terminal member extend outwardly from said body portion in opposite directions, and securing means disposed in said chamber to secure said twisted section to said body portion, the end of said terminal member that is received in said receptacle having precious metal on the outer surface thereof that operatively interconnects with said receptacle.

2. A plug in igniter system as set forth in claim 1 wherein said terminal member comprises stainless steel.

3. In a plug in igniter system for a fuel burning apparatus having at least one electrical receptacle and a plug in igniter unit provided with a housing means having an electrical igniter therein and terminal means electrically interconnected to said electrical igniter and projecting from said housing means to be received in said receptacle for electrical interconnection thereto, the improvement wherein said terminal means comprises at least one blade-like terminal member having opposed ends respectively being interconnected to said igniter and said receptacle and being twisted between said opposed ends thereof to define a twisted section thereof, said housing means having a body portion provided with a chamber passing therethrough and receiving said twisted section therein whereby said opposed ends of said terminal member extend outwardly from said body portion in opposite directions, securing means disposed in said chamber to secure said twisted section to said body portion, said receptacle comprising a body member having at least one socket opening therein receiving the respective end of said terminal member, and a lead carried by said body member and having a conductive socket disposed in said body member and aligned with said opening to conductively receive said respective end of said terminal member, said body member comprising a plurality of parts secured together to hold said conductive socket therein, one of said parts comprising a mounting bracket, said mounting bracket having bendable means that secures all of said parts of said receptacle together in their assembled relation.

4. In a plug in igniter unit for an igniter system for a fuel burning apparatus having at least one electrical receptacle, said plug in igniter unit being provided with a housing means having an electrical igniter therein and terminal means electrically interconnected to said electrical igniter and projecting from said housing means so as to be adapted to be received in said receptacle for electrical interconnection thereto, the improvement wherein said terminal means comprises at least one blade-like terminal member having opposed ends respectively being operatively interconnected to said igniter and being adapted to be plugged in said receptacle and being twisted between said opposed ends thereof to define a twisted section thereof, said housing means having a body portion provided with a chamber passing therethrough and receiving said twisted section therein whereby said opposed ends of said terminal member extend outwardly from said body portion in opposite directions, and securing means disposed in said chamber to secure said twisted section to said body portion, the end of said terminal member that is adapted to be received in said receptacle having precious metal on the outer surface thereof that is adapted to operatively interconnect with said receptacle.

5. A plug in igniter unit as set forth in claim 4 wherein said terminal member comprises stainless steel.

6. In a method of making a plug in igniter unit for an igniter system for a fuel burning apparatus having at least one electrical receptacle, said plug in igniter unit being provided with a housing means having an electrical igniter therein and terminal means electrically interconnected to said electrical igniter and projecting from said housing means so as to be adapted to be received in said receptacle for electrical interconnection thereto, the improvement comprising the steps of forming said terminal means from at least one blade-like terminal member having opposed ends for respectively being operatively interconnected to said igniter and to plug into said receptacle, twisting said terminal member between said opposed ends thereof to define a twisted section thereof, forming said housing means to have a body portion provided with a chamber passing therethrough, disposing said twisted section in said chamber whereby said opposed ends of said terminal member extend outwardly from said body portion in opposite directons, disposing securing means in said chamber to secure said twisted section to said body portion, and disposing precious metal on the end of said terminal member that is adapted to be received in said receptacle.

7. A method of making a plug in igniter unit as set forth in claim 6 and including the step of forming said terminal member from stainless steel.

* * * * *